United States Patent [19]

Werner

[11] Patent Number: 4,772,024

[45] Date of Patent: Sep. 20, 1988

[54] GAME OF CHANCE DEVICE

[75] Inventor: Wilfred M. Werner, Covina, Calif.

[73] Assignee: Fred N. Schwend, Mira Loma, Calif.; a part interest

[21] Appl. No.: 49,849

[22] Filed: May 15, 1987

[51] Int. Cl.[4] ..... A63B 71/00; A63F 7/40

[52] U.S. Cl. ..... 273/144 B; 273/139

[58] Field of Search ..... 273/144 R, 144 A, 144 B, 273/138, 139 R, 139 A, 139 B

[56] References Cited

U.S. PATENT DOCUMENTS

| | | | |
|---|---|---|---|
| 1,207,908 | 12/1916 | Harness | 273/139 |
| 1,866,063 | 7/1932 | Sloan | 273/144 B |
| 3,092,390 | 6/1963 | Super | 273/139 X |
| 3,095,655 | 7/1963 | Berglund et al. | 273/139 X |
| 3,420,525 | 1/1969 | Waders . | |
| 3,584,825 | 6/1971 | Pickford . | |
| 3,776,552 | 12/1973 | Lemelson . | |

*Primary Examiner*—Carlton R. Croyle
*Assistant Examiner*—Eugene L. Szczecina, Jr.
*Attorney, Agent, or Firm*—Fred N. Schwend

[57] ABSTRACT

Inclined chutes are filled with game balls of different colors or other visual characteristics. The underlying wall of each chute is formed of elastomeric material with openings therein of smaller diameters than the diameters of the balls so that the balls may roll down the chute and rest against each other and against a stop under the influence of gravity. Depressible plungers aligned with the openings may be selectively depressed to displace underlying balls through the openings from which they are guided to a display station.

8 Claims, 1 Drawing Sheet

GAME OF CHANCE DEVICE

BACKGROUND OF THE INVENTION

This invention relates to game devices and has particular reference to game devices involving the element of chance.

SUMMARY OF THE INVENTION

A principal object of the invention is to provide a game device which provides high degree of amusement and excitement to persons of all ages.

Another object is to provide a game device which can be played by any number of persons.

Another object is to provide a game device which does not require a high degree of mental or physical dexterity.

A further object is to provide a game device including movable game pieces which are contained within the device and thus cannot become misplaced or host.

A still further objects is to provide a game device of the above type which is simple and inexpensive to manufacture and yet reliable in operation.

BRIEF DESCRIPTION OF THE DRAWINGS

The manner in which the above and other objects of the invention are accomplished will be readily understood on reference to the following specification when read in conjunction with the accompanying drawings, wherein.

DESCRIPTION OF THE PREFERRED EMBODIMENT

Figure 2:
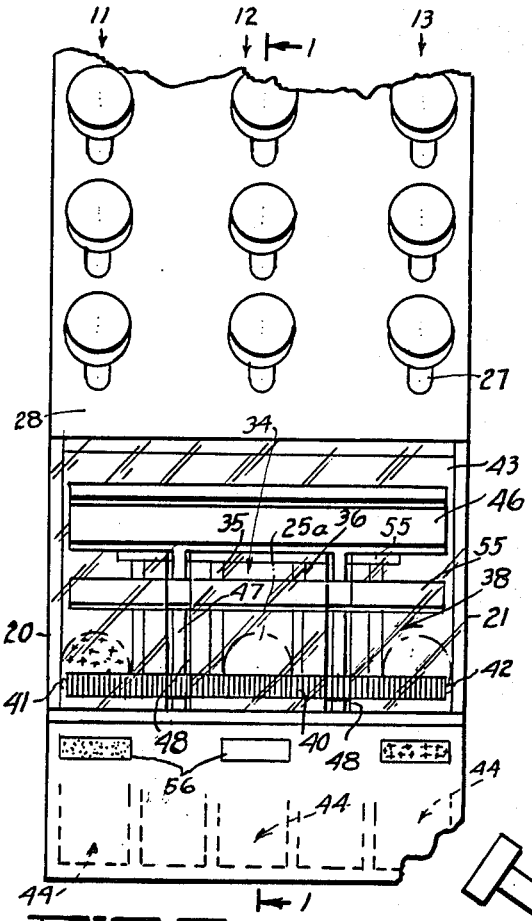
FIG. 2 is a front elevational view, partly broken away, of the game device.

Referring to the drawings, the game device comprises a plurality of similar game units generally indicated at 11, 12, and 13, arranged in side by side relation.

Figure 3:
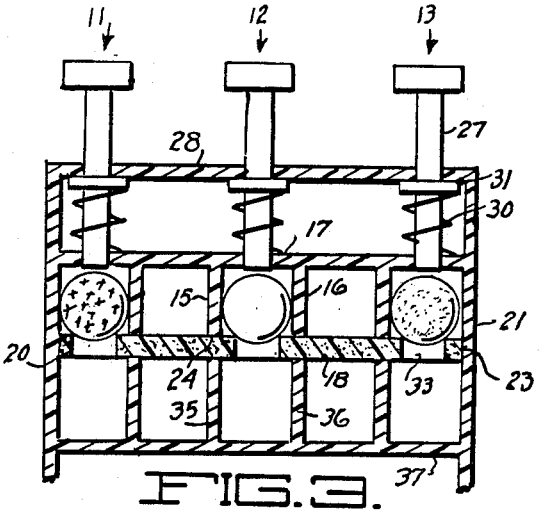
FIG. 3 is a transverse sectional view taken along line 3—3 of FIG. 2.
Figure 1:
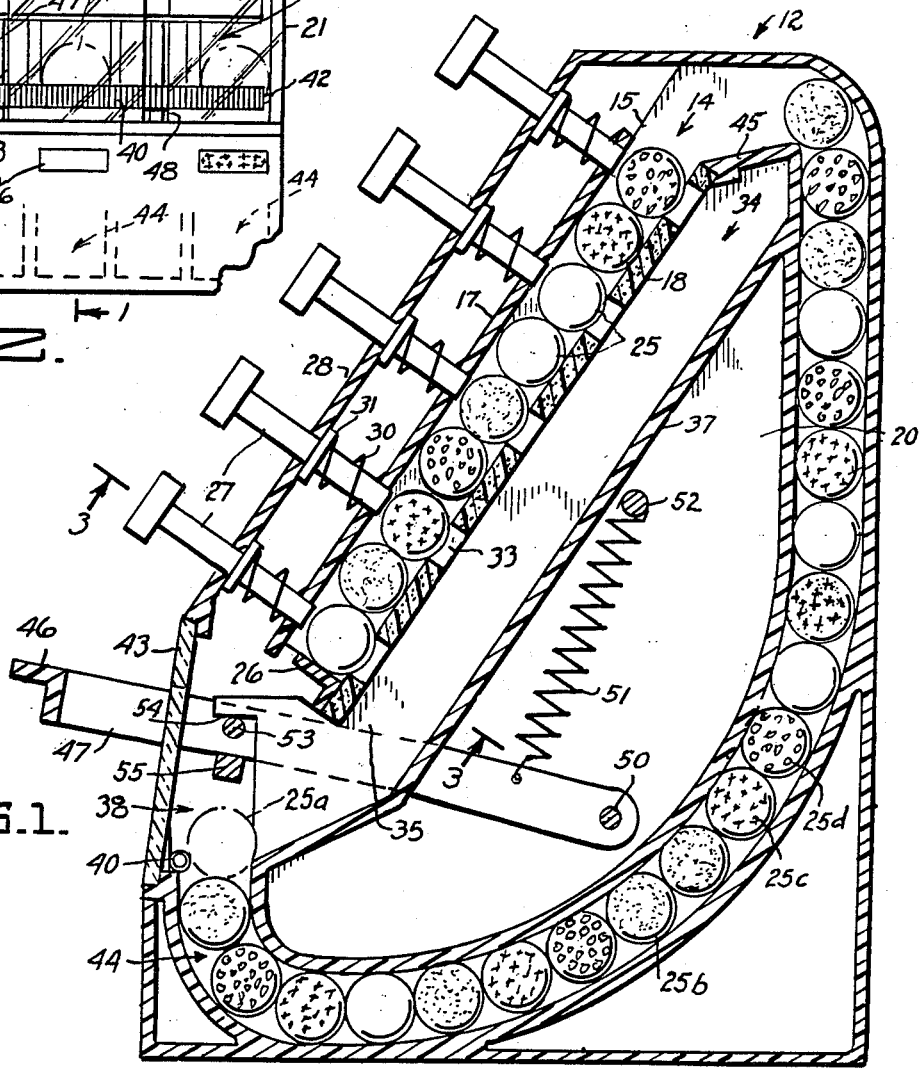
FIG. 1 is a longitudinal sectional view through one of the game units and is taken along line 1—1 of FIG. 2.

As seen particularly in FIGS. 1 and 3, each gane unit comprises an inclined ball guide chute 14, including side walls 15 and 16, a top wall, 17, and a bottom wall 18. The top and side wall are peferably formed of opaque plastic material which may be either molded in one piecce or frabricated of seaprate pieces integrally united as by the use of suitable adhesive.

The top wall 17 is common to all game units and is integrally united with side walls 20 and 21 of the device.

The bottom wall, 18, of the chute 14 is formed of relatively soft resilient rubber or other elastomeric material and, as seen in FIG. 3, is common to corresponding chutes of all three game units. The wall 18 is secured along its side edges at 23 to the walls 20 and 21 by a suitable adhesive and is likewise secured to the under edges of the sides walls 15 and 16 at 24, by a suitable adhesive. The chute 14 is filled with a series of balls or game pieces 25 which rest against each other by gravity, the lower most ball resting against a stop member, 26, extending across the device and suitably attached to the side walls, 20 and 21.

A row of plunges, 27, is located above chute 14. The plungers are aligned with alternate ones of the balls 25 and each is slideable in bearings formed in the top chute wall, 17, and in an outer casing wall, 28 which is integrally united with the side walls 20 and 21. Compression springs, 30, are fitted over the plungers and are interposed between the top chute wall, 28 and collars, 31, integral with the plungers to normally hold the latter in their upper illustrated positions.

Upon depression of any plunger, 27, it will force an underlying ball, 25, through an underlying opening, 33, in the bottom wall 18, the opening normally being of somewhat smaller diameter than the diameter of each of the balls 25, so that the balls can normally roll downwardly along the chute without passing through the holes.

As a ball 25 is forced through an aligned opening, 33, in the bottom wall 18 by an aligned plunger, it drops into an inclined delivery chute, 34 formed by a side walls, 35 and 36 united with a bottom wall 37 which is common to all game units and is united along its outer edges with the side walls 20 and 21.

The depressed ball rolls down to a registering or display station generally indicated at 38, where it comes to rest in a position indicated by dot-dash lines **25*a* against the side of a tension spring 40. The later extends across the game device and is suitably secured at its ends 41 and 42 to the side walls 20 and 21. The ball at the display station 38, becomes visible to the player through a transparent panel or window, 43 inset in the casing wall 28**.

Accordingly, when different plungers, 27, in the game units 11, 12, and 13, are depressed, the underlying balls, will descend along their respective delivery chutes 34 and will register in a horizontal row as in FIG. 2, where they are visible through the window 43.

A ball return chute 44, in each game unit extends between the registering station, 38, and a point adjacent the upper end of the chute 14, where it terminates at an inclined shelf, 45 leading to the associated chute 14.

A ball return ball 46, is provided to remove any balls, i.e. **25*a*, from the registering station, 38. The legs 47 of the ball 46 extend through slots 48 in the window 43 and are pivoted on a cross rod 50 extending between the sidewalls 20 and 21. A spring, 51 is tensioned between one of the legs 47 and a cross rod 52 to normally hold the bail in its upper illustrated position where a bail rod 53 thereon limits against a stop shoulder 54 formed on one or more of the side walls, 35 and 36**.

Upon depression of the bail **46*a* cross bar 54 thereon, will depress any or all balls at the dipslay station, forcing them past the tension spring 40 and into the return chute 44. The latter is preferably filled with balls 25 so that as a ball is forced into the chute, the train of balls will be advanced toward the upper end of the associated ball chute 14 causing the uppermost ball to roll along the shelf 45 into the chute 14**, thereby continually maintaining the latter chute filled with balls.

Different ones of the balls 25 preferably have different visual surface characteristics, such as colors, and such balls are randomly arranged in the different chutes of the units 11, 12, and 13. For example, balls **25*b*, indicated as stippled may be colored red, balls 25*c*, indicated with cross marks may be colored blue, balls 25*d***, indicated with small circles thereon may be colored yellow, and the remaining unmarked balls colored white. Thus, different colored balls in any combination may appear in the display station or it may be that balls of the same color might appear at the display station, this depending entirely on the element of chance.

Different games may be played depending on the player's or players' discretion. For example, color markers 56 (FIG. 2) may be located adjacent the display station 38 in line with the different delivery chutes 34. Players may take their turn depressing different plungers 27 to release balls in the different games units and the player who releases balls at the display station matching in color the markers 56 wins the game.

More sophisticated games may be played using betting odds. For exmaple, the combination of red, white and blue balls at the display station would win odds of ten to one, the combination of three balls of any one color at the display station would win odds of five to one, and a blue ball in the right hand or blue section would win odds of two to one.

Any number of variations in scoring may be set up and odds may be changed, for example, by varying the numers of the different colored balls as desired.

Although the deivce is illustrated as emboying three game units (11, 12, and 13) arranged in side by side relation, the basic aspects of the invention could encompass only a single game unit or any additional number of units other than that disclosed.

I claim:

1. A game device comprising a guide chute having a lower end and an upper end, a delivery chute, said chutes having a common wall of resilient material, said wall having spaced openings therein, means forming a stop adjacent said lower end of said guide chute, said game pieces being effective to move along said guide chute and against each other and said stop by gravity, said game pieces being larger than said openings, a plurality of depressible plungers arranged along the length of said guide chute, means supporting said plungers in line with respective ones of said openings whereby depression of any one of said plungers will displace an aligned one of said game pieces through one of said openings and into said delivery chute, and means forming a registering station, said delivery chute being effective to guide a displaced one of said game pieces to said registering station.

2. A game device as defined in claim 1 wherein said guide chute and said delivery chute extend parallel to each other.

3. A game device as defined in claim 2 wherein said chutes extend at an angle to the horizon.

4. A game device as defined in claim 1 wherein different ones of said game pieces have different visual characteristics.

5. A game device as defined in claim 1 comprising means for returning said game pieces from said registering station to said upper end of said chute.

6. A game device as defined in claim 1 comprising a return chute extending between said registering station and said upper end of said first mentioned chute, and means for returning said game pieces from said registering station along said return chute to said upper end of said first mentioned chute.

7. A game device as defined in claim 1 comprising a return chute extending between said registering station and said upper end of said first mentioned chute, said return chute, being at least substantially filled with said game pieces, and means for moving a said game piece that is at said registering station into one end of said return chute whereby to cause a game piece at the opposite end of said chute to advance into said first mentioned chute.

8. A game device comprising a plurality of guide chutes arranged side by side, each of said chutes having a lower end and an upper end, a plurality of delivery chutes, respective ones of said guide chutes and said delivery chutes having a common wall of resilient material, said wall having spaced openings therein extending between said guide chutes and respective ones of said delivery chutes, a plurality of game pieces of different visual characteristics in said guide chutes, said game pieces being effective to move along guide chutes and against each other and said stop means by gravity, said game pieces being larger than said openings, a plurality of depressible plungers, means supporting said plungers in line with respective ones of said openings in said guide chutes whereby depression of any of said plungers will displace an underlying said game piece through an aligned one of said openings and into a respective one of said delivery chutes, means forming a registering station, said delivery chutes being effective to guide displaced ones of said game pieces to said registering station, return chutes extending between said registering station and different ones of said guide chutes, said return chutes being at least substantially filled with said game pieces, a manually operable member, and means responsive to operation of said member for moving said game pieces at said registering station into said return chutes whereby to move said game pieces at the upper ends of said return chutes into said (first mentioned) guide chutes.

* * * * *